US012137776B2

(12) United States Patent
Kucharko

(10) Patent No.: US 12,137,776 B2
(45) Date of Patent: Nov. 12, 2024

(54) SHOE EQUIPPED WITH A SHOELACE

(71) Applicants: FIRST WEST GMBH, Vienna (AT); Jerzy Franciszek Kucharko, Vienna (AT)

(72) Inventor: Jerzy Franciszek Kucharko, Vienna (AT)

(73) Assignees: FIRST WEST GMBH, Vienna (AT); Jerzy Franciszek Kucharko, Vienna (AT)

( * ) Notice: Subject to any disclaimer, the term of this patent is extended or adjusted under 35 U.S.C. 154(b) by 502 days.

(21) Appl. No.: 17/431,321

(22) PCT Filed: Feb. 18, 2020

(86) PCT No.: PCT/AT2020/000003
§ 371 (c)(1),
(2) Date: Aug. 16, 2021

(87) PCT Pub. No.: WO2020/168369
PCT Pub. Date: Aug. 27, 2020

(65) Prior Publication Data

US 2022/0132994 A1 May 5, 2022

(30) Foreign Application Priority Data

Feb. 18, 2019 (AT) ..... A 58/2019

(51) Int. Cl.
*A43C 5/00* (2006.01)
*A43B 23/02* (2006.01)

(52) U.S. Cl.
CPC ..... *A43C 5/00* (2013.01); *A43B 23/02* (2013.01)

(58) Field of Classification Search
None
See application file for complete search history.

(56) References Cited

U.S. PATENT DOCUMENTS 756,690 A 4/1904 Nowels
797,743 A 8/1905 McCoy
(Continued)

FOREIGN PATENT DOCUMENTS

CH 264894 A 11/1949
DE 446586 C 7/1927
(Continued)

OTHER PUBLICATIONS

International Search Report and Written Opinion of the International Searching Authority, issued in PCT/AT2020/000003, mailed Jun. 8, 2020; ISA/EP.

*Primary Examiner* — Jila M Mohandesi
(74) *Attorney, Agent, or Firm* — Harness, Dickey & Pierce, P.L.C.

(57) ABSTRACT

The invention relates to a shoe which has two rows of laceholes (4) in the planar upper (3) thereof and a shoelace (1) threaded into the laceholes (4) and an edging element (2, 9, 14) which is fastened to one of the laceholes (4) in the upper (3) and is fixed against movement away from the lacehole (4) and has a through-hole (5) through which the shoelace (1) extends. A rigid connection that is permanent, that is to say cannot be detached non-destructively, is provided between the edging element (2, 9, 14) and the longitudinal region of the shoelace (1) passing through said element.

12 Claims, 4 Drawing Sheets

(56) References Cited

U.S. PATENT DOCUMENTS

Figure 1:
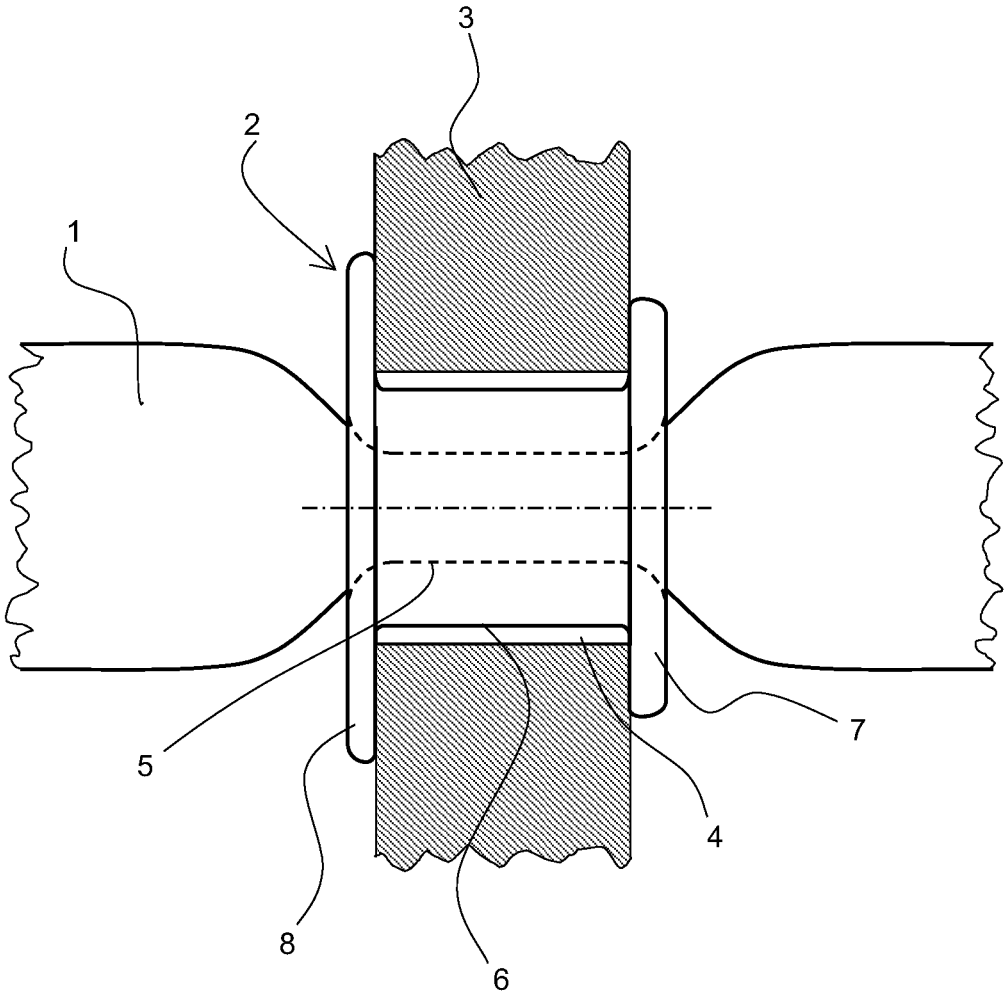

| | | | | | |
|---|---|---|---|---|---|
| 1,161,027 | A | * | 11/1915 | Clark | A43C 3/00 24/714.5 |
| 1,381,949 | A | * | 6/1921 | Van Deusen | A43C 5/00 24/715.2 |
| 1,466,673 | A | * | 9/1923 | Solomon | A43C 3/02 24/713.9 |
| 1,489,470 | A | * | 4/1924 | Thomas | A43C 3/00 24/713.7 |
| 3,467,996 | A | * | 9/1969 | Voice | F16B 19/10 411/501 |
| 3,526,977 | A | | 9/1970 | Murphy et al. | |
| 4,258,456 | A | | 3/1981 | Thurston et al. | |
| 5,016,327 | A | | 5/1991 | Klausner | |
| 5,913,618 | A | * | 6/1999 | Yosha | G09F 3/20 24/3.12 |
| 9,003,618 | B2 | * | 4/2015 | Violato | A41F 1/02 24/713.7 |
| 9,149,089 | B2 | * | 10/2015 | Cotterman | A43C 3/00 |
| D837,685 | S | * | 1/2019 | Miki | D11/200 |
| 2011/0107619 | A1 | * | 5/2011 | Esquivel | B25B 13/08 81/119 |
| 2011/0162123 | A1 | | 7/2011 | Ly | |
| 2013/0047470 | A1 | | 2/2013 | Smith | |
| 2014/0259295 | A1 | * | 9/2014 | Guglielmo | A43B 1/0027 2/245 |
| 2017/0112237 | A1 | | 4/2017 | Ringholz et al. | |

FOREIGN PATENT DOCUMENTS

| | | | |
|---|---|---|---|
| DE | 1625874 | U | 7/1951 |
| DE | 202011003919 | U1 | 5/2011 |
| WO | WO-2016020898 | A1 | 2/2016 |

* cited by examiner

SHOE EQUIPPED WITH A SHOELACE

CROSS-REFERENCE TO RELATED APPLICATIONS

This application is a 371 U.S. National Stage of International Application No. PCT/AT2020/000003, filed on Feb. 18, 2020, which claims priority to Australian Application No. A 58/2019, filed on Feb. 18, 2019. The entire disclosures of the above applications are incorporated herein by reference.

The invention relates to a shoe which is equipped with a shoelace.

Usually, a shoe equipped with shoelaces has, in that part of the planar upper that is intended to cover the instep of a foot, two rows of eyelets, i.e. through-holes, through the planar upper that extend approximately parallel to the ridgeline of the instep at a distance from one another. A shoelace (a lace or a cord) is threaded through the individual eyelets such that it forms a zigzag line along which in each case an eyelet of one row and an eyelet of the other row alternately follow one another. In each case one of the two free end pieces of the shoelace (usually) projects from the respectively upper eyelet of the two rows. In order to tighten the shoe around a foot, the two ends of the shoelace are pulled, with the result that the two rows of eyelets are moved toward one another. In order to wear a shoe, the two ends of the tightened shoelace are fixed in a releasable manner—usually to one another—such that the shoelace remains tensioned. In order to take the shoe off, the fixing of the ends of the shoelace is released such that the tension in the shoelace can decrease; the two rows of eyelets are moved away from one another with the result that the ends of the shoelace are pulled toward the respectively next hole in the row of eyelets.

By way of example, the documents CH 264894 A, DE 446586 C, DE 1625874 U and U.S. Pat. No. 3,526,977 A each disclose a shoelace which is provided at one end with a terminal part which has a much greater diameter than the shoelace and typically has the form of a flat circular disk. As intended, such a shoelace is threaded with the thin end first into the bottommost hole of a row of holes and then pulled in a zigzag through the holes in the two rows of holes until it bears by way of the terminal part against the planar material of the shoe from the inner side at the bottommost hole. The thin, free end of the shoelace is pulled such that the shoelace is tensioned. In order to maintain the tension in the shoelace, use is made of a retaining element which is fixed to the shoe and to which the free end region of the shoelace can be firmly clamped. The purpose of this lacing is to make it easier for people who have only one hand available to tension and fix the shoelace.

The documents U.S. Pat. Nos. 797,743 A, 756,690 A and WO 2016020898 A1 disclose shoes in which one or two through-holes in the planar upper are edged by a respective retaining element. The retaining element has elements to which the end region, threaded through the edged through-hole, of the shoelace is able to be releasably fixed. The retaining elements replace the otherwise usual knotting together of the two ends of a shoelace.

In many laced shoes, in particular those with very short rows of eyelets, the problem arises of the shoelaces shifting over time with respect to the eyelets such that one end of a shoelace projects from the upper eyelet so as to be too long and the second end is too short, and so the two ends can no longer be tied together in a neat knot.

For example, DE 20 2011 003 919 U1 proposes clamping a clamping part as blocking element on each segment of a shoelace that lies between the two bottommost eyelets of the two rows of eyelets, said clamping part having the form of a longitudinally slotted circular cylindrical shell and clamping the shoelace so tightly that the latter can no longer slip. The blocking element is too bulky to be able to slide through eyelets, with the result that the entire shoelace is secured against disruptive significant slipping. A drawback is especially the visual appearance of the blocking element; it can significantly impair an elegant appearance of a shoe.

The problem addressed by the invention is that of configuring a shoe that has two rows of eyelets and a shoelace threaded into the latter such that the shoelace is connected so firmly to the upper of the shoe at a point at a distance from its two ends, preferably in the central region of its longitudinal extent, that there is no shifting between the upper and the shoelace at the connecting point for the period that the shoelace is used—i.e. not only when wearing or not wearing the shoe but also when lacing and unlacing. In this case, the means used for connecting the shoelace and upper should be precisely positionable on the shoe and optionally also be able to be embodied in a visually inconspicuous manner.

To solve the problem, the prior art feature has been adopted whereby a through-hole in the upper of the shoe is edged with an element that is permanently fixed in an immovable manner with respect to the upper, and whereby a shoelace extends through the through-hole in the upper and thus also through the edging element.

As a development according to the invention, it is proposed to provide a permanent rigid connection (i.e. a rigid connection that is not releasable without being destroyed) between the edging element and the longitudinal region, extending through the latter, of the shoelace.

Specifically, said rigid connection should be designed to be at least so firm that, under the forces, to be expected during the use of the shoe, at the connecting point between the shoelace and the edging element, these two parts do not shift with respect to one another.

As a result of the edging element being fixed at the eyelet, its position with respect to the upper is defined very precisely, with the result that it is readily possible to design the edging element as an element that visually suits the shoe.

Typically—and preferably—the edging element is arranged at the bottommost eyelet of a row of those two rows of holes in the upper of the shoe that extend along a rising line, typically along the instep of the foot, when the shoe is being worn.

Typically—and preferably—the permanent connection between the edging element and the shoelace is located in the central longitudinal region of the shoelace, typically at 48% to 52% of the total length of the shoelace away from one end of the shoelace.

In a particularly preferred embodiment, the edging element has three annular bodies that are located one after another in their axial direction, are rigidly connected together and have mutually different outside diameters, wherein the annular body with the smallest outside diameter is located between the two other annular bodies, which have larger outside diameters. Thus, the edging element can be dimensioned in such a simple manner that its central annular body passes through an eyelet and such that the diameter of the two outer annular bodies is greater than the diameter of the eyelet with the upper relaxed, with the result that the edging element is prevented from shifting on the upper normally to the plane of the planar upper in both directions.

An annular body in this context is a body which has a central through-hole of which the lateral surface is largely encircled. The outer circumference of the annular body does not necessarily have to be circular in this regard. The encircling of the lateral surface of the through-hole also does not necessarily have to be closed.

For the connection between the edging element and the shoelace, it is possible in the simplest case for the lateral surface of the shoelace to be enclosed so closely by the edging element that the shoelace is under radially oriented pressure as a result and the two parts are held together simply by significant friction. However, the connection can also be formed or reinforced by spikes or hooks, which penetrate into the shoelace from the edging element, or by adhesive bonding or welding.

The best form of the connection between the shoelace and edging element is probably the one which is formed by the edging element being embodied as an injection-molded plastics part which is produced by overmolding the shoelace (which for this purpose extends through the mold cavity of the plastics injection-molding machine).

In the optimum case, the connection between the shoelace and the edging element is firmer than the connection between the edging element and the upper of the shoe. In this way, it is possible to mount a shoelace equipped with an edging element on a shoe by the shoelace being threaded through that eyelet in the shoe at which the edging element is intended to be attached, until the edging element bears against the eyelet. Then, the shoelace is pulled further with a brief forceful tug such that the edging element is pulled into the eyelet and remains fixed therein by a force fit. In order to change the shoelace together with the edging element fixed thereto, it is possible to briefly pull the shoelace forcefully counter to the original threading direction, such that the edging element is pulled out of its engaged position at the eyelet.

The invention is illustrated by way of two drawings:

FIG. 1: shows a view in partial section, with a section plane parallel to the longitudinal direction of the shoelace, of the detail, relevant here, of an example of a shoe configured according to the invention.

Figure 2:
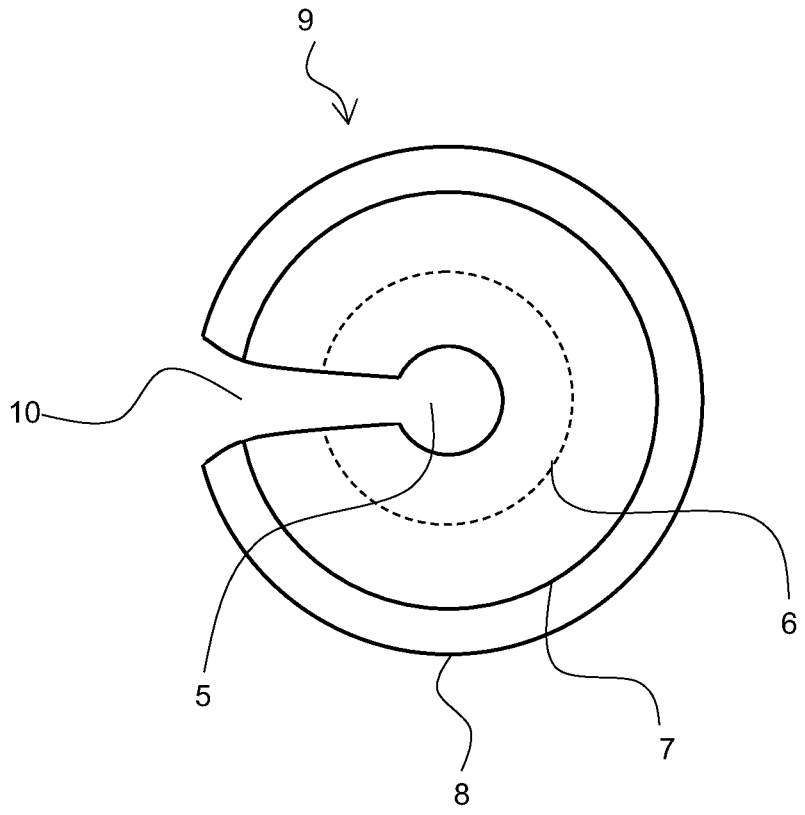

FIG. 2: shows a frontal view of a further example of an edging element that is usable according to the invention, on its own.

Figure 3:
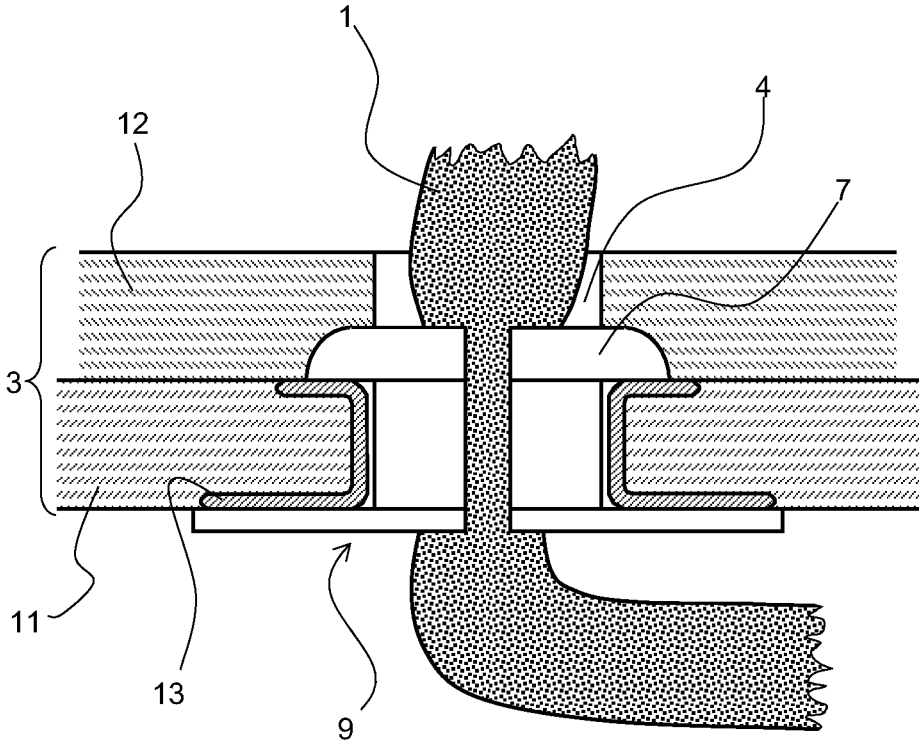

FIG. 3: shows a view in partial section of the relevant detail of a shoe equipped with the edging element in FIG. 2.

Figure 4:
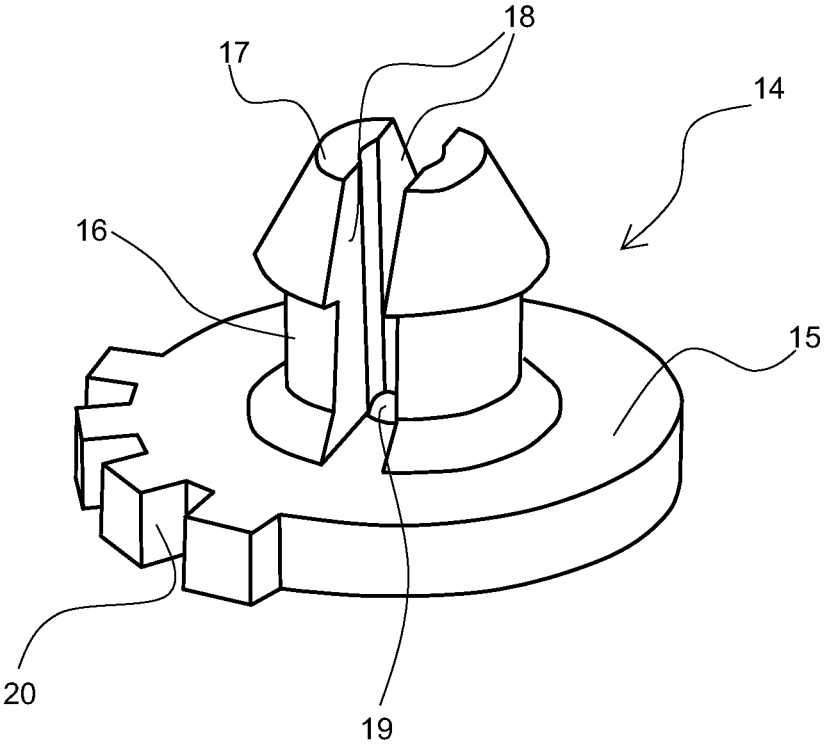

FIG. 4: shows a perspective illustration of a third example of an edging element that is usable according to the invention, on its own.

FIG. 1 shows a shoelace 1, an edging element 2 and the upper 3 of a shoe equipped according to the invention, in a state joined together as intended.

The edging element 2 is fixed in the upper 3 at an eyelet 4, and the shoelace 1 extends through a through-hole 5 in the edging element 2.

In this example, the edging element 2—as described above—is formed from three annular bodies located one after another, which together encircle the "common" through-hole 5. The central annular body 6 of the edging element 2 extends through the eyelet 4. It has a smaller diameter than the two annular bodies adjoining it at its end faces, namely the outer annular body 7 bearing on the outer side of the upper 3 and the inner annular body 8 bearing on the inner side of the upper 3.

The diameter of the outer annular body 7 is ideally dimensioned such that, by significantly exploiting the elastic deformability of itself and of the upper 3 or of an edging, present in any case, of the eyelet 4, it can be pushed with its side facing away from the central annular body 6 at the front through the eyelet 4, or can be pulled through the eyelet 4 by means of the shoelace fastened to the edging element 2. As tests with prototypes have shown, good dimensions can be determined easily therefor by tests.

The diameter of the inner annular body 8 can be even larger than that of the outer annular body 7, since it never needs to be moved through an eyelet 4.

If the rigid connection between the shoelace 1 and edging element 2 is intended to be based only on friction, the diameter of the through-hole 5 in the edging element 2 is ideally just tight enough that the shoelace 1 can only just be pulled through it by overcoming a strong frictional force, without being noticeably damaged. The optimal dimensions in this regard are also easy to determine by testing.

As already mentioned above, the joining together of the shoelace 1 and edging element 2, rather than by "forcible" pulling of the shoelace 1 through the through-hole 5, can also be formed for example by the edging element being formed by overmolding the shoelace 1 with plastic and thus already being connected to the shoelace 1 on being produced.

It is for example also possible to configure the through-hole 5 more extensively than illustrated relative to the relaxed cross-sectional dimensions of the shoelace 1 and to fix the connection between the edging element 2 and the shoelace 1 by means of adhesive or a kind of soldering or by means of a pin extending transversely to the direction of the through-hole 5 or small spikes, hooks or ribs extending transversely to the direction of the through-hole 5.

FIG. 2 shows an edging element 9 that differs from the one in FIG. 1 in that it has a longitudinal slot 10 which is open toward both end faces of the edging element 9 and which interrupts the annular bodies 6, 7, 8 such that they form open rings, and thus the lateral surface of the through-hole 5 is also interrupted toward the outside in a narrow circumferential region.

The longitudinal slot 10 entails advantages that the edging element 9, when it is not yet arranged on the upper of the shoe, can easily be pushed radially onto the shoelace 1 to be anchored thereto, and that the edging element 9 is elastically deformable in a further region such that the anchoring operation at an eyelet 4 in the upper 3 can be effected more easily.

FIG. 3 shows an example of a particularly advantageous structure of a shoe according to the invention.

As in very many shoes, in particular in many leather shoes, the upper 3 consists of two layers, namely an inner layer 11 (which is usually a textile) and an outer layer 12 (which is mostly leather or imitation leather). Of the eyelets 4, in each case only the longitudinal region of the inner layer 11 is edged by a grommet 13. (There are, of course, also leather shoes in which the grommet is visible on the surface of the outer layer.)

In the advantageous embodiment shown in FIG. 3, the edging element 9 has been plugged through the grommet 13 at the eyelet 4 from the inner side of the upper 3 and is short enough that the outer annular body 7 just protrudes beyond the grommet 13 but does not protrude from the outer layer 12. In this way, the edging element 9 is extremely inconspicuous and apparent only when seen from a very short distance. The visibility can be reduced even further if the color of the edging element 9 is the same as or similar to that of the outer layer 12 or of those grommets 13 that are located at eyelets at which an edging element 9 is not fitted.

FIG. 4 shows an edging element 14 which is able to be mounted particularly readily by being inserted into an eyelet in the upper of a shoe. The edging element 14 is again constructed from three annular bodies 15, 16, 17, wherein the central annular body 16 has the smallest diameter.

In the case of those two annular bodies 16, 17 that have to be pushed into an eyelet in order to mount the edging element 14, the lateral surface is interrupted by one or more longitudinal slots 18, with the result that the remaining material of these annular bodies 16, 17 forms spring tongues which are readily suited to being inserted into an eyelet and to catch to prevent being pulled out—even when the eyelet is edged by a grommet (FIG. 3). The annular body 17 that is located at the front during insertion into an eyelet is tapered frustoconically in the manner of an arrow tip, thereby making the insertion operation even easier.

The widest annular body 15 is not slotted at all; it also does not need to be plugged through an eyelet.

A through-hole 19 again passes through all the annular bodies 15, 16, 17 of the edging element 14. Preferably, the diameter of the through-hole 19 is smaller than that of the shoelace to be plugged through the latter as intended, when the shoelace is not compressed by pressure. This not only has the effect that the shoelace can be sufficiently retained at the edging element 14 by friction alone but also that the spring tongues formed by the annular bodies 16, 17 are prevented from deforming, as a result of which they could be pulled back out of the eyelet in the upper.

Of course, the edging element 14 according to FIG. 4 can also be formed already by overmolding a shoelace with plastic and be connected to the shoelace.

Especially the widest annular body 15, which is not intended to be plugged through an eyelet, can also be used as a decorative element or a label element on a shoe. To this end, the edging element 14 should be plugged into an eyelet in the upper of a shoe from the outside to the inside with the annular body 17 tapering in an arrow-like manner at the front. The widest annular body 15 then remains clearly visible in the field of view on the outer surface of the upper.

As an indication that the widest annular body 15 is equipped with decorative elements or a label element, for example a company logo, the lateral protrusions 20 are illustrated by way of example in FIG. 4. With structures such as protrusions 20, but also by means of indentations etc., it is also possible for different dimensions of edging elements to be characterized, such that it is very easy to distinguish between and identify differently dimensioned edging elements.

According to a specific advantageous embodiment of an edging element, the latter is equipped with an electronic identification circuit, for example an RFID chip. This identification circuit can be overmolded by the plastics material that forms the main part of the edging element, or it can have been adhesively bonded to a surface region of the edging element.

This option is conceivable for example for particularly high-quality safety shoes, which are issued to employees by companies and the use of which is intended to be monitored and/or enforced when working in some hazardous areas.

The invention claimed is:

1. A shoe having a planar upper region and including two rows of eyelets and a shoelace having a longitudinal region threaded into the eyelets, and an edging element which is fastened to the planar upper at one of the eyelets and is fixed so as not to move away from the eyelet and has a through-hole through which the shoelace extends, wherein the edging element is permanently and rigidly connected to the longitudinal region of the shoelace, such that this connection extends through the longitudinal region and cannot be released without destruction of the connection, and wherein the edging element includes a plastic material molded over the longitudinal region of the shoelace.

2. The shoe as claimed in claim 1, wherein the diameter of the through-hole is precisely small enough that the shoelace can only be pulled through it by overcoming a strong frictional force without being noticeably damaged, and/or where in the connection between the edging element and the shoelace at the through-hole is fixed by means of adhesive, soldering, one or more transversely extending pins, one or more transversely extending spikes, one or more transversely extending hooks, or one or more transversely extending ribs.

3. The shoe as claimed in claim 1, wherein the edging element is arranged at the bottommost eyelet of the two rows of eyelets in the upper planar of the shoe, with the rows extending along a rising line when the shoe is worn.

4. The shoe as claimed in claim 1, wherein the edging element is permanently and rigidly connected to the central longitudinal region of the shoelace.

5. The shoe as claimed in claim 1, wherein the edging element further comprises three annular bodies arranged one after another in the axial direction, rigidly connected together, and each annular body having a different outside diameters, and wherein the annular body with the smallest outside diameter is located between the two other annular bodies, which both have larger outside diameters.

6. The shoe as claimed in claim 5, wherein the outside diameters of the two annular bodies with the larger outside diameter are different from one another.

7. The shoe as claimed in claim 5, wherein the edging element has a longitudinal slot open toward the two end sides of the edging element, the slot extending radially from an outer lateral surface of the annular bodies to the through-hole of the edging element passing through all of the annular bodies.

8. The shoe as claimed in claim 5, wherein that-two adjacent annular bodies are split into individual spring tongues by one or more longitudinal slots.

9. The shoe as claimed in claim 1, wherein the upper planar has an inner layer and an outer layer, and the edging element protrudes beyond the inner layer on both sides in a direction normal to the layer plane at one of the eyelets, but not beyond the outer layer.

10. The shoe as claimed in claim 9, wherein that the lateral surface of the eyelet is edged in a region of the inner layer by a grommet, but not in a region of the outer layer, and wherein the edging element extends through the grommet.

11. The shoe as claimed in claim 1, wherein the edging element protrudes beyond the outer side of the upper planar and has a decorative element or a label element on the protruding part of the edging element.

12. The shoe as claimed in claim 1, wherein the edging element is equipped with an electronic identification circuit.

* * * * *